US008106601B2

(12) United States Patent
Liu et al.

(10) Patent No.: US 8,106,601 B2
(45) Date of Patent: Jan. 31, 2012

(54) LED ILLUMINANT DRIVING CIRCUIT AND AUTOMATIC BRIGHTNESS COMPENSATION METHOD THEREOF

(75) Inventors: Yi-Te Liu, Hsinchu County (TW); Chih-Yuan Hsieh, Hsinchu (TW); Chih-Jen Yen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 272 days.

(21) Appl. No.: 12/478,735

(22) Filed: Jun. 4, 2009

(65) Prior Publication Data

US 2010/0156309 A1 Jun. 24, 2010

(30) Foreign Application Priority Data

Dec. 18, 2008 (TW) ..... 97149535 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/291; 315/225; 315/307

(58) Field of Classification Search ..... None
See application file for complete search history.

(56) References Cited

U.S. PATENT DOCUMENTS

2009/0273290 A1* 11/2009 Ziegenfuss ..... 315/193
2010/0141178 A1* 6/2010 Negrete et al. ..... 315/307

* cited by examiner

*Primary Examiner* — Anh Tran
(74) *Attorney, Agent, or Firm* — Jianq Chyun IP Office

(57) ABSTRACT

An LED illuminant driving circuit and an automatic brightness compensation method thereof are provided herein. The automatic brightness compensation method includes: providing a target value; detecting an operation period of a pulse of an output of the LED illuminant driving circuit, the pulse is adapted to an LED illuminant for making the light emitting; deciding a peak value according to the target value and the operation period; and setting a peak level of the pulse according to the peak value. The LED illuminant driving circuit and the automatic brightness compensation method thereof provides a stable average current/voltage to the LED illuminant and avoids brightness variations of the light emitting.

9 Claims, 6 Drawing Sheets

LED ILLUMINANT DRIVING CIRCUIT AND AUTOMATIC BRIGHTNESS COMPENSATION METHOD THEREOF

CROSS-REFERENCE TO RELATED APPLICATION

This application claims the priority benefit of Taiwan application serial no. 97149535, filed on Dec. 18, 2008. The entirety of the above-mentioned patent application is hereby incorporated by reference herein and made a part of specification.

BACKGROUND OF THE INVENTION

1. Field of the Invention

The present invention relates to an illuminant adjustment technique, and more particularly, to an LED illuminant driving circuit and an automatic brightness compensation method thereof.

2. Description of Related Art

FIG. 1 shows a block diagram of a conventional LED illuminant device. Referring to FIG. 1, an LED illuminant device 10 includes an electronic transformer 100, a rectifier circuit 110, an input capacitor Cin, a driving circuit 120, and an LED illuminant 130. First, an output of an electronic transformer 100 with a conventional alternating current (AC) to AC transformation is a high frequency AC voltage VAC2. For example, when an AC voltage VAC1 with low frequency of 60 Hz is applied, the AC voltage VAC1 is transformed by the electronic transformer 100 to an AC voltage VAC2 with high frequency of 25 KHz to 100 KHz, wherein root-mean-squared voltage (Vrms) of the AC voltage VAC1 and the AC voltage VAC2 is 110V and 12V respectively. Then, the AC voltage VAC2 output from the electronic transformer 100 is connected with the rectifier circuit 110 and the input capacitor Cin. The rectifier circuit 110 and the input capacitor Cin produces a direct current (DC) voltage VDC with ripple components on the AC voltage VAC2. Furthermore, a power input terminal VIN of the driving circuit 120 receives a DC voltage VDC to make the LED illuminant 130 emit light.

Referring to FIG. 2, FIG. 2 shows the DC voltage VDC with ripple components of FIG. 1. When the driving circuit 120 utilizes the DC voltage VDC with ripple components as an input power source, the following conditions may occur:

(1) The ripples of the DC voltage VDC causes a periodic operation of a starting time and a stopping time so as to impact on a working stability of the driving circuit 120.

(2) The ripples of the DC voltage VDC influences the LED illuminant 130 at an output terminal of the driving circuit 120, and the ripple which causes variations of average current or average voltage of the LED illuminant 130 also causes the variations of brightness of the LED illuminant 130

In the driving circuit 120 of the related art, due to the impact from the DC voltage VDC with ripples, the average current or the average voltage conducted through the LED illuminant 130 will not be controlled stably. It also means the brightness of the LED emitting light may be different so it causes inconvenience of applications. Therefore, there is a need for an LED illuminant driving circuit and an automatic brightness compensation method thereof accordingly.

SUMMARY OF THE INVENTION

Accordingly, the present invention provides an automatic brightness compensation method of an LED illuminant driving circuit. The method decides a peak value according to a target value and an operation period of a pulse output from the LED illuminant driving circuit, and then sets a peak level of the pulse according to the peak value so as to achieve stability of average current or average voltage for driving the LED illuminant.

An LED illuminant driving circuit is also provided in the present invention. The LED illuminant driving circuit includes a driver unit and an automatic brightness compensation circuit. The LED illuminant driving circuit utilizes the automatic brightness compensation circuit to detect output from the driver unit, decide a peak value according to a target value and an operation period of a pulse output from the driver unit, and then control the driver unit according to the peak value to set a peak level of the pulse so as to achieve stability of driving the LED illuminant.

The automatic brightness compensation method of an LED illuminant driving circuit is provided in the present invention. The automatic brightness compensation method includes: providing a target value; detecting an operation period of a pulse output from the LED illuminant driving circuit; deciding a peak value according to the target value and the operation period; and setting a peak level of the pulse according to the peak value.

In one embodiment of the present invention, the step of detecting the operation period of the pulse output from the LED illuminant driving circuit in the above-described automatic brightness compensation method of an LED illuminant driving circuit includes: counting a turn-on period and a cut-off period of the pulse; and calculating the operation period according to the turn-on period and the cut-off period.

In one embodiment of the present invention, the target value in the above-described automatic brightness compensation method of an LED illuminant driving circuit is a setting value of average current or average voltage for driving the LED illuminant.

In one embodiment of the present invention, the step of setting the peak level of the pulse according to the peak value in the above-described automatic brightness compensation method of an LED illuminant driving circuit includes: generating a control signal according to the peak value to set the peak level of the pulse.

The LED illuminant driving circuit is provided in the present invention. The LED illuminant driving circuit includes a driver unit and an automatic brightness compensation circuit. The driver unit outputs a pulse to drive an LED illuminant. The automatic brightness compensation circuit is coupled to the driver unit for detecting an operation period of the pulse, deciding a peak value according to a target value and the operation period, controlling the driver unit according to the peak value to set a peak level of the pulse according to the peak value.

In one embodiment of the present invention, the automatic brightness compensation circuit of the above-described LED illuminant driving circuit includes a turn-on counter, a cut-off counter, and an operation period calculation circuit. The turn-on counter counts a turn-on period. The cut-off counter counts a cut-off period. The operation period calculation circuit calculates the operation period according to the turn-on period and the cut-off period.

In one embodiment of the present invention, the automatic brightness compensation circuit of the above-described LED illuminant driving circuit includes an average load setting circuit and a feedback compensation setting circuit. The average load setting circuit sets the target value as a setting value of the average current or the average voltage of the LED illuminant. The feedback compensation setting circuit generates a control signal to set the peak value according to the target value and the operation period.

In one embodiment of the present invention, the LED illuminant of the above-described LED illuminant driving circuit is an MR16 lamp.

The present invention detects the operation period of the pulse output from the LED illuminant to acquire the control signal for feedback compensation of the driver unit so as to control the brightness of the LED illuminant. Therefore, an automatic compensation mechanism is produced to provide stable average current or average voltage to the LED illuminant so as to avoid variations of the brightness of the LED illuminant.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
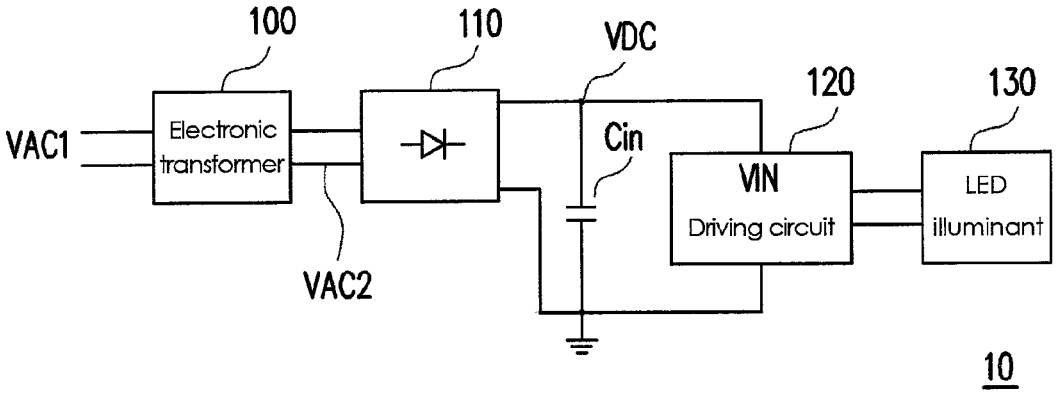
FIG. 1 is a block diagram of a conventional LED illuminant device.
Figure 2:
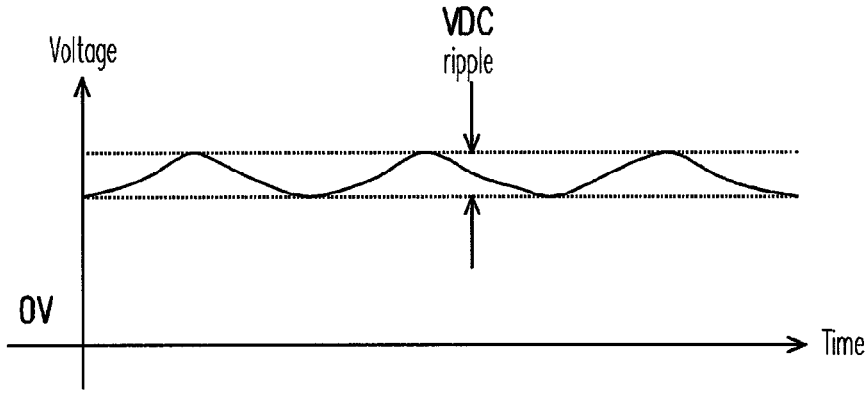
FIG. 2 shows a DC voltage VDC with voltage ripple components of FIG. 1.
Figure 3:
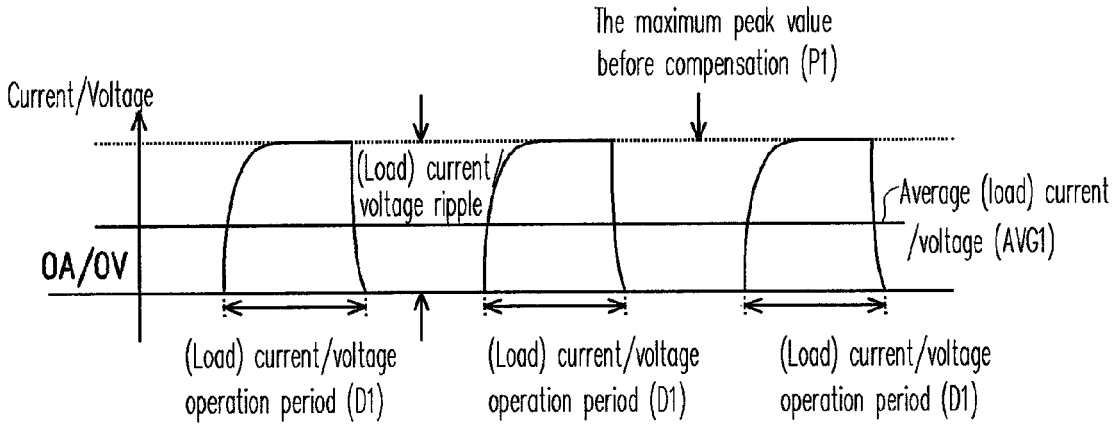
FIG. 3 and FIG. 4 shows waveform diagrams of a (load) current or voltage before compensation.
Figure 4:
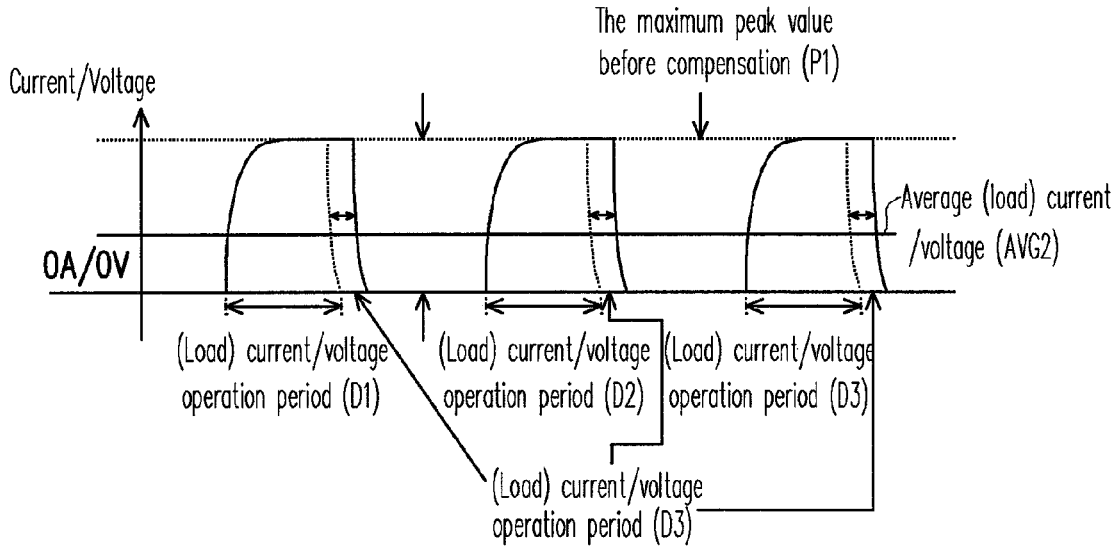

FIG. 3 and FIG. 4 show waveform diagrams of a (load) current or voltage before compensation. Referring to FIG. 3 and FIG. 4, an input capacitor Cin impacts the DC voltage VDC such that the DC voltage VDC has ripples. Furthermore, the DC voltage VDC having ripple components varies an average current or average voltage on a load. As shown in FIG. 3, an operation period of the load current or voltage of a pulse is D1, the average load current of voltage is AVG1, a maximum peak value of the pulse is P1, and a waveform of the varied pulse is illustrated in FIG. 4. The operation period of the (load) current or voltage of the pulse as shown in FIG. 4 is changed to D2 or D3. The possible conditions may be one of the following: D2=D1−D3 or D2=D1+D3. However, the maximum peak value at this time is not changed, and the values of average (load) current/voltage is changed to AVG2, therefore, it is possible to get a situation of AVG2<AVG1 or a situation of AVG2>AVG1. As a result, the value of average current or voltage will be varied.

Figure 5:
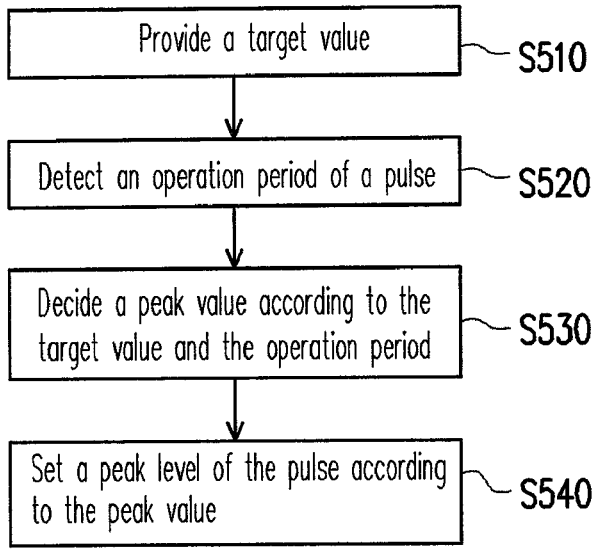
FIG. 5 shows a flowchart of an automatic brightness compensation in an LED illuminant driving circuit of one embodiment of the present invention.

FIG. 5 shows a flowchart of an automatic brightness compensation in an LED illuminant driving circuit according to an embodiment of the present invention. Referring to FIG. 5, the automatic brightness compensation method may be applied to the LED illuminant driving circuit of an illuminant device in order to solve an unstableness of the illuminant device caused by voltage ripples and variations of illuminant brightness. The automatic brightness compensation method includes the following steps. First, in step S510, a target value is provided, and the target value may be utilized as a setting value of the average current or the average voltage to drive the LED illuminant. Next, in step S520, an operation period of a pulse output from the LED illuminant driving circuit is detected. Then, in step S530, a peak value according to the target value and the operation period is decided. Furthermore, in step S540, a peak level of the pulse is set according to the peak value.

Figure 6:
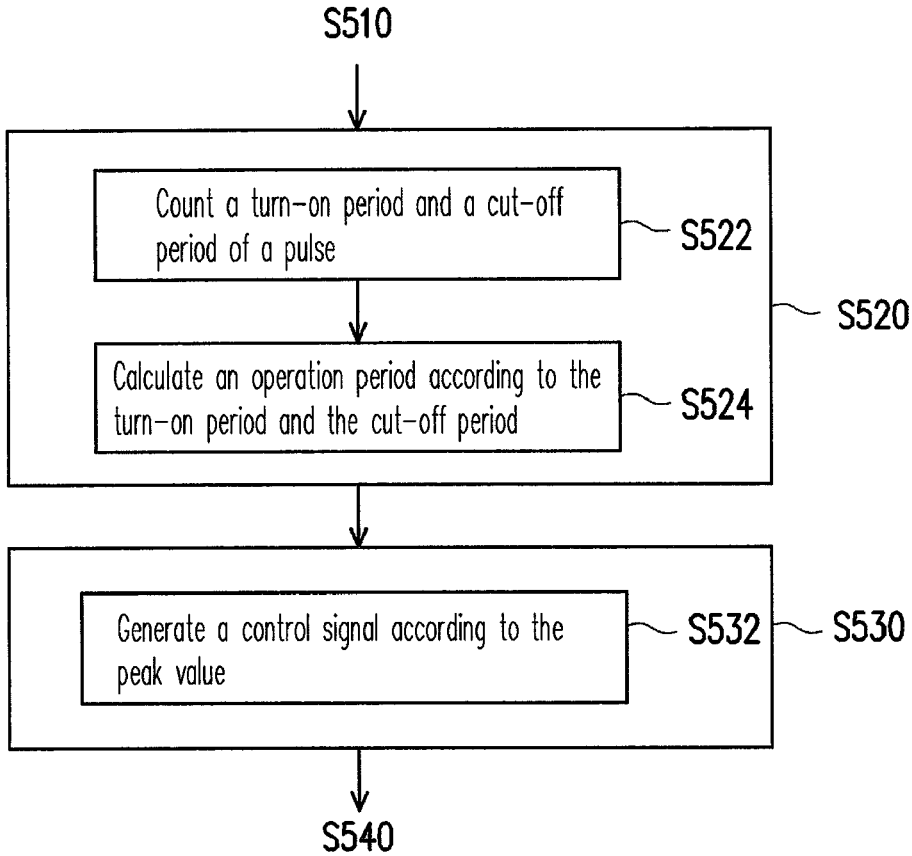
FIG. 6 shows a flowchart of an automatic brightness compensation in an LED illuminant driving circuit of another embodiment of the present invention.

FIG. 6 shows a flowchart of an automatic brightness compensation in an LED illuminant driving circuit according to another embodiment of FIG. 5. Referring to FIG. 6, when the above-described automatic brightness compensation method of FIG. 5 is proceeded in step S520, the step may further includes the following steps: in step S522, a turn-on period and a cut-off period of the pulse output from the LED illuminant driving circuit are counted; next, in step S524, the operation period is calculated according to the turn-on period and the cut-off period. Then, when the above-described automatic brightness compensation method of FIG. 5 proceeds in step S530, step S532 may be processed to generate a control signal for setting the peak level of the pulse output from the LED illuminant driving circuit.

Figure 7:
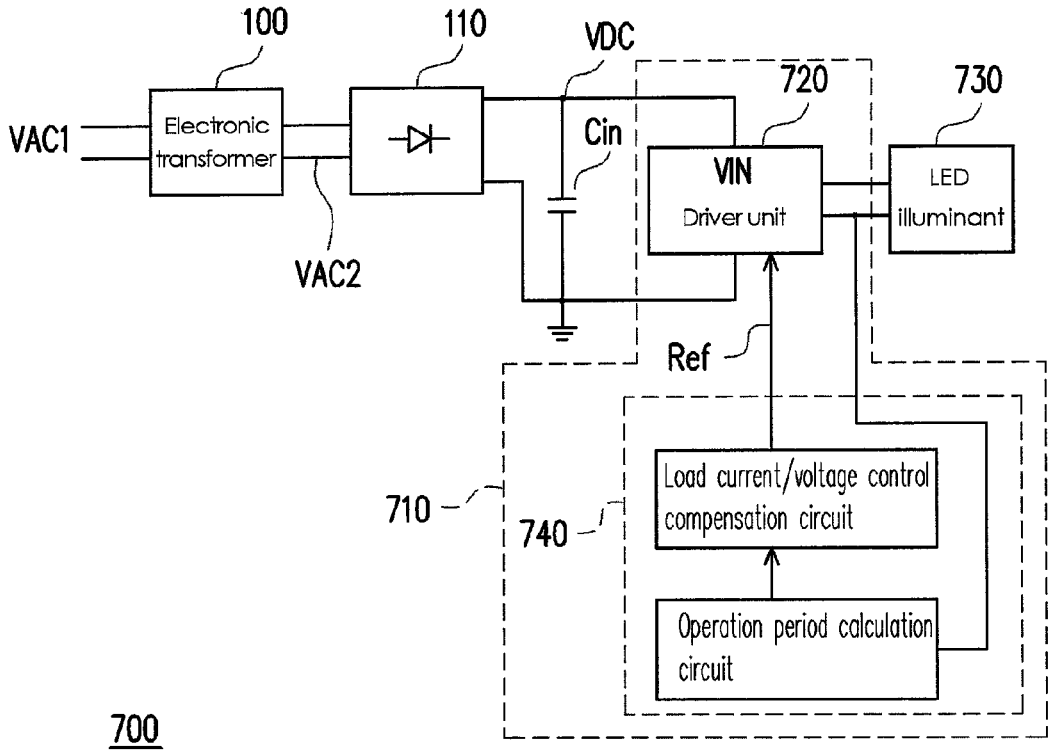
FIG. 7 shows a block diagram of an LED illuminant device of one embodiment of the present invention.

FIG. 7 shows a block diagram of an LED illuminant device according to one embodiment of the present invention. Referring to FIG. 7, the LED illuminant device 700 may include an electronic transformer 100, a rectifier circuit 100, an input capacitor Cin, an LED illuminant driving circuit 710, and an LED illuminant 730. In this embodiment, the LED illuminant driving circuit 710 includes a driver unit 720 and an automatic brightness compensation unit 740. A power input terminal VIN of the driver unit 720 receives the DC voltage VDC having ripples components, in order to output a pulse to drive the LED illuminant 730. The automatic brightness compensation circuit 740 is coupled to the driver unit 720 to detect an operation period of the pulse, and then decides a peak value according to a target value and the operation period, and controls the driver unit 720 according to the peak value such that the driver unit 720 then sets a peak level of the pulse according to the peak value.

Figure 8:
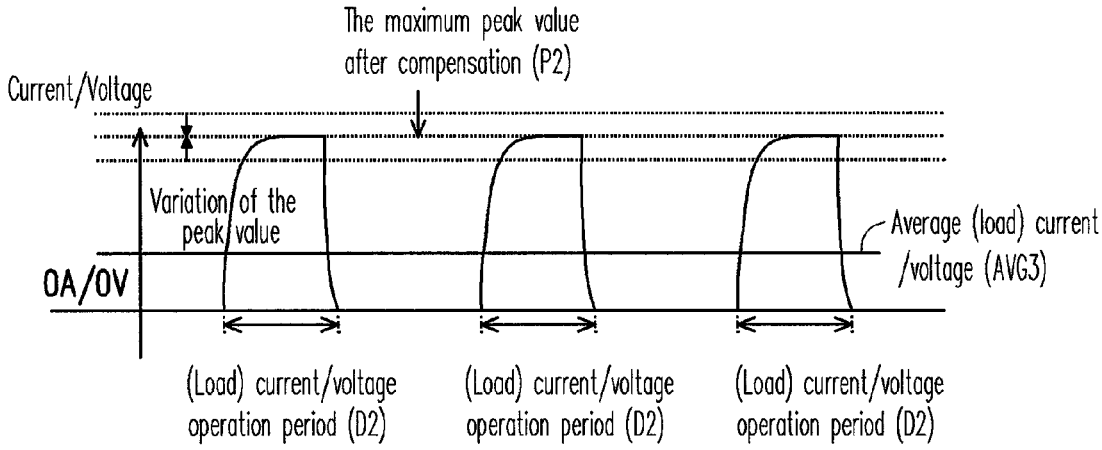
FIG. 8 shows a waveform of a (load) current or voltage after compensation according to one embodiment of the present invention.

In order to stabilize the average current or the average voltage of the LED illuminant 730, the automatic brightness compensation circuit 740 is used to generate a feedback control signal Ref to the driver unit 720. The driver unit 720 is able to stably maintain the average current or the average voltage of the LED illuminant 730 according to the feedback control signal Ref. FIG. 8 shows a waveform diagram of a (load) current or voltage after compensation according to one embodiment of the present invention. Please refer to FIG. 8 in accordance with FIG. 4 and FIG. 3. The working principle of the automatic brightness compensation circuit 740 is as the following: before compensation, the output pulse of the driver unit 720 as shown in FIG. 4 has the operation period of the pulse as D2; after compensation, the operation period of the output pulse of the driver unit 720 is not changed but the peak value of the output pulse of the driver unit 720 is set as P2 for a result of compensation. Therefore, a situation of P2>P1 or a situation of P2<P1 is obtained. And setting of P2 may be embodied as follows: for example, if the target value of the average current is AVG1, then P2 is set as the value of AVG1 divided by D2. It means at last the average current or the average voltage values AVG3 of the output pulse of the driver unit 720 is equal to the target value AVG1. This means that the average load current or the average load voltage values of the LED illuminant 730 is not changed, and hence, a functionality of the automatic brightness compensation of the LED illuminant may be obtained to make a stable and uniform emitting light brightness of the LED illuminant.

Figure 9:
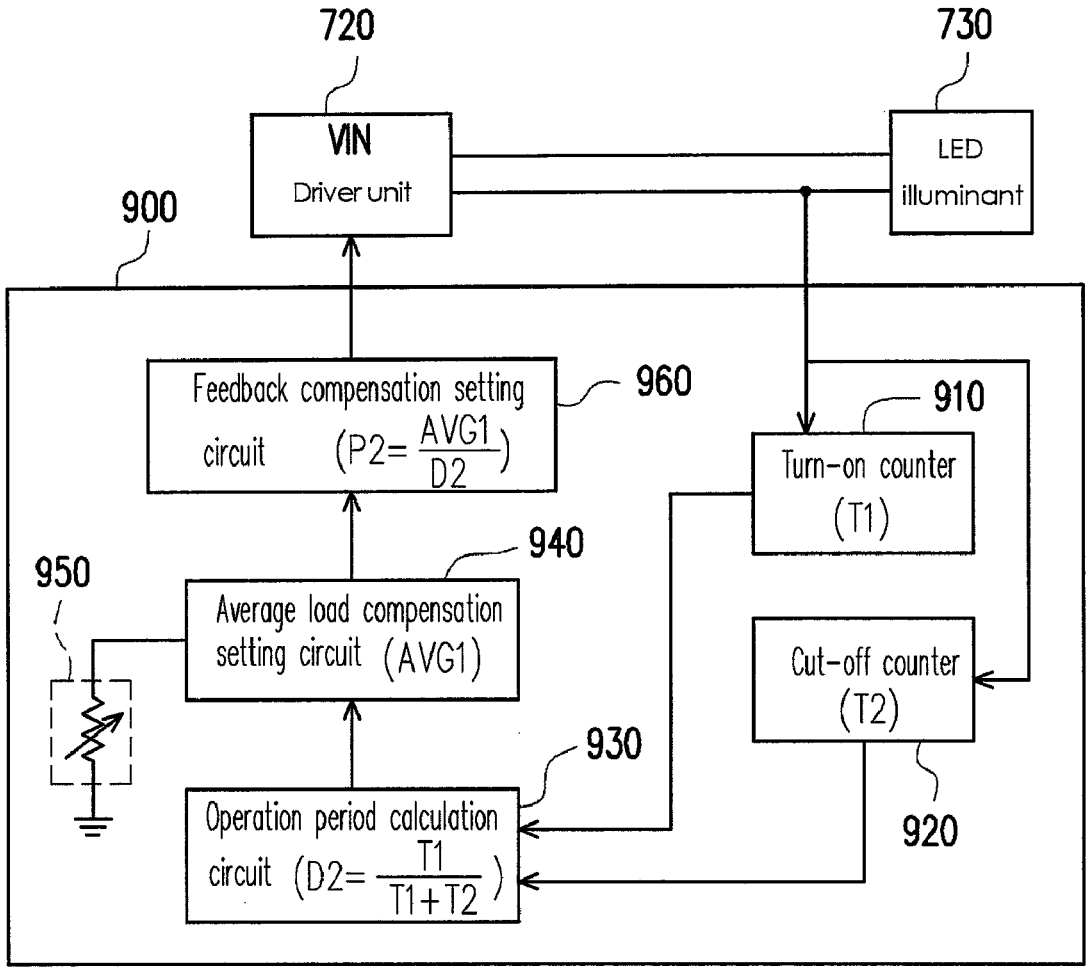
FIG. 9 is a block diagram of an LED illuminant device of another embodiment of the present invention.

FIG. 9 shows a block diagram of an LED illuminant device of another embodiment of the present invention. Referring to FIG. 9, the power input terminal VIN of the driver unit 720 receives a DC voltage VDC as shown in FIG. 7, and the automatic brightness compensation circuit 900 is coupled to the driver unit 720 and the LED illuminant 730. The automatic brightness compensation circuit 900 may include a turn-on counter 910, a cut-off counter 920, an operation period calculation circuit 930, an average load setting circuit 940, and a feedback compensation circuit 960.

Figure 10:
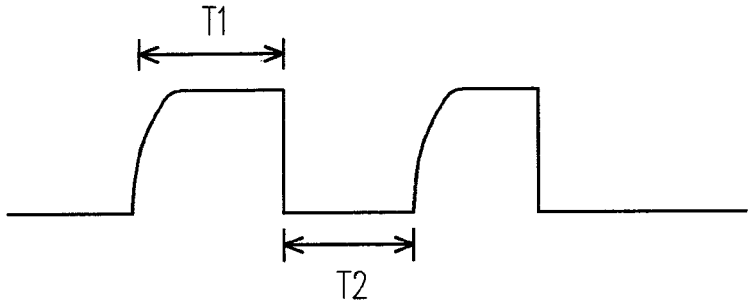
FIG. 10 shows a waveform of the pulse output from the driver unit 720 of FIG. 9.

FIG. 10 shows a waveform of the pulse output from the driver unit 720. Referring to FIG. 10, the pulse output from the driver unit 720 is similar to a square wave, and the turn-on period and the cut-off of each operation period is T1 and T2 respectively. Referring to FIG. 9, the main purpose of the turn-on counter 910 is to count the turn-on period T1 of the pulse output from the driver unit 720, and the cut-off counter 920 is used for counting the cut-off period T2 of the pulse output from the driver unit 720. Surely, the turn-on counter 910 can be used to count the turn-on period T1 of current or voltage on the LED illuminant 730 instead of the pulse, and the cut-off counter 920 to count the cut-off period T2 of current or voltage on the LED illuminant 730 instead of the pulse. These changes belong to the scope of the present invention. Next, the operation period calculation circuit 930 is utilized to generate current operation period D2 according to counting results from the turn-on counter 910 and the cut-off counter 920 to generate. In this embodiment, D2=T1/(T1+T2). The average load setting circuit 940 is connected to an output terminal of the operation period calculation circuit 930, and together with a variable resistor 950 to form a setting unit for setting the target value AVG1 of the average current or the average voltage output from the driver unit 720 or for setting the target value AVG1 of the average current or the average voltage conducting through the LED illuminant 730. The feedback compensation circuit 960 is connected to the output end of the average load setting circuit 940 for obtaining the target value AVG1 and the operation period D2 of the average current or the average voltage of the LED illuminant 730. The first compensation is mentioned previously as illustrated in the FIG. 3 and FIG. 4. Then, after processed by the feedback compensation circuit 960, where the way of process does not change the operation period D2 of the average current or the average voltage and sets the peak value of the output pulse to P2, or alternatively, the way of processing may also set the maximum peak value of the load current or the load voltage to P2 as a result of compensation so as to achieve a situation of P2>P1 or a situation of P2<P1. The above-described feedback compensation circuit 960 may operate as the followings. For example, the target value of the average current is AVG1, and then P2 is equal to the value of AVG1 divided by D2. The feedback compensation circuit 960 generates a feedback control signal Ref after processing. The control signal Ref is transferred to the driver unit 720. The driver unit 720 compensates the average current or the average voltage of the LED illuminant 730 according to the feedback control signal Ref. The embodiment detects the variations of the operation period to compensate the average current or the average voltage so as to maintain them such that the automatic brightness compensation of the LED illuminant is achieved.

Figure 11:
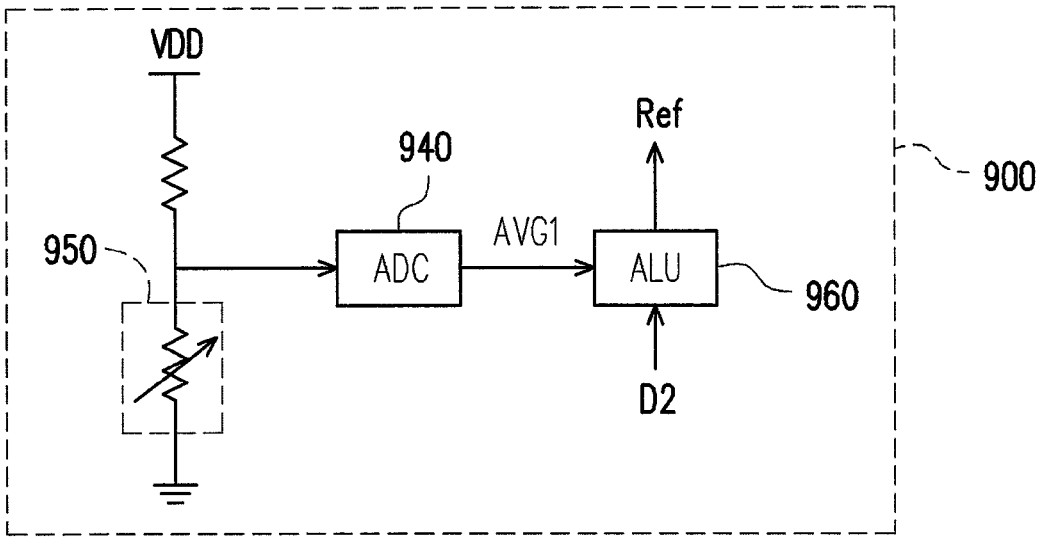
FIG. 11 shows another embodiment of the automatic brightness compensation circuit.

FIG. 11 shows another embodiment of the automatic brightness compensation circuit 900. In this embodiment, the average load setting circuit 940 may be implemented with an Analog-to-Digital Converter (ADC), and the feedback compensation circuit 960 may be implemented with an Arithmetic Logic Unit (ALU), where the ALU receives the target value AVG1 and the operation period D2 and generates the feedback control signal Ref after computation of P2 (equal to the value of AVG1 divided by D2).

It is noted that in the above-described embodiments, the illuminant device 700 may be an MR16 lamp, but surely may be an E26 lamp or an E27 lamp.

It is understood by people skilled in the field that embodiments of the present invention are not limited to the embodiments disclosed above, embodiments may be varied according to design requirements, so long as realizations, which detect the operation period of the pulse output from the LED illuminant driving circuit and use the operation period and the target value to set the peak level of the pulse, fall within domains of the present invention.

In summary, the embodiments of the present invention have at least the following advantages:

(1) having an automatic brightness compensation mechanism to provide stable average current/voltage to the LED illuminant (load) so as to avoid variations of illuminant brightness;

(2) may applies to the LED illuminant (load) requiring stable average current or average voltage to make brightness of emitting light uniform and in turn enhances convenience of applications, for example, the LED illuminant may be applied to an MR16 lamp, an E26 lamp or an E27 lamp.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. An automatic brightness compensation method of an LED illuminant driving circuit, the automatic brightness compensation method comprising:

providing a target value;

detecting an operation period of a pulse output from the LED illuminant driving circuit;

deciding a peak value according to the target value and the operation period; and setting a peak level of the pulse according to the peak value;

wherein the step of detecting the operation period of the pulse output from the LED illuminant driving circuit comprises: counting a turn-on period and a cut-off period of the pulse; and calculating the operation period according to the turn-on period and the cut-off period.

2. The automatic brightness compensation method as claimed in claim 1, wherein the target value is a setting value of average current or average voltage for driving the LED illuminant.

3. The automatic brightness compensation method as claimed in claim 1, wherein the step of setting the peak level of the pulse according to the peak value comprising:

generating a control signal according to the peak value to set the peak level of the pulse.

4. An LED illuminant driving circuit, comprising:

a driver unit for outputting a pulse to drive the LED illuminant; and an automatic brightness compensation circuit coupled to the driver unit for detecting an operation period of the pulse, deciding a peak value according to a target value and the operation period, and controlling the driver unit according to the peak value to set a peak level of the pulse;

wherein the automatic brightness compensation circuit comprises: a turn-on counter for counting a turn-on period; a cut-off counter for counting a cut-off period; and an operation period calculation circuit for calculating the operation period according to the turn-on period and the cut-off period.

5. The LED illuminant driving circuit as claimed in claim 4, wherein the automatic brightness compensation circuit comprising:

an average load setting circuit for setting the target value as a setting value of the average current or the average voltage; and a feedback compensation setting circuit for generating a control signal according to the target value and the operation period to set the peak value.

6. The LED illuminant driving circuit as claimed in claim 4, wherein the LED illuminant is applied to an MR16 lamp, an E26 lamp or an E27 lamp.

7. A lamp, comprising:

an LED illuminant;

a driver unit coupled to the LED illuminant for outputting a pulse to drive the LED illuminant; and an automatic brightness compensation circuit coupled to the driver unit for detecting an operation period of the pulse, deciding a peak value according to a target value and the operation period, and controlling the driver unit according to the peak value to set a peak level of the pulse;

wherein the automatic brightness compensation circuit comprises: a turn-on counter for counting a turn-on period; a cut-off counter for counting a cut-off period; and an operation period calculation circuit for calculating the operation period according to the turn-on period and the cut-off period.

8. The lamp as claimed in claim 7, wherein the automatic brightness compensation circuit comprising:

an average load setting circuit for setting the target value as a setting value of average current or average voltage; and a feedback compensation setting circuit for generating a control signal according to the target value and the operation period to set the peak value.

9. The lamp as claimed in claim 7, wherein the lamp is an MR16 lamp, an E26 lamp or an E27 lamp.

* * * * *